US006338720B1

(12) United States Patent
Morikawa et al.

(10) Patent No.: US 6,338,720 B1
(45) Date of Patent: Jan. 15, 2002

(54) COLLECTION DEVICE FOR COLLECTING LIQUID SAMPLE

(75) Inventors: Naoki Morikawa; Tooru Oomori; Masafumi Takemoto, all of Yamanashi (JP)

(73) Assignee: Terumo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/397,093

(22) Filed: Sep. 16, 1999

(30) Foreign Application Priority Data

Feb. 8, 1999 (JP) ..... 11-030586

(51) Int. Cl.[7] ..... A61B 5/00; B65D 81/00
(52) U.S. Cl. ..... 600/584
(58) Field of Search ..... 600/584, 573; 422/56; 606/4–5

(56) References Cited

U.S. PATENT DOCUMENTS 5,100,620 A 3/1992 Brenneman
5,114,862 A 5/1992 Brenneman
5,753,429 A 5/1998 Pugh
5,827,279 A * 10/1998 Hughett et al. ..... 606/45
6,083,460 A * 7/2000 Morikawa et al. ..... 422/56

* cited by examiner

*Primary Examiner*—John P. Lacyk
*Assistant Examiner*—Brian Szmal
(74) *Attorney, Agent, or Firm*—Burns, Doane, Swecker & Mathis, LLP

(57) ABSTRACT

A specimen collection tip for collecting a specimen includes a base portion, a slender tube extending from one face of the base portion, a plurality of elastically deformable mounting claws extending from the opposite face of the base portion, and a test paper is set in place on the opposite face of the base portion. The base portion is generally in the shape of a flat disc and has a pedestal part for supporting and fixing the test paper. The opposite face of the base portion also includes a flange part formed at the outer peripheral side of the base portion. The lower face of the flange part is formed in a generally flat plane. When the tip is inserted into a tip receiving part of an analyte measuring device, the lower face of the flange part contacts the leading end of the tip receiving part to fix the position of the tip with respect to the tip receiving part.

23 Claims, 6 Drawing Sheets

COLLECTION DEVICE FOR COLLECTING LIQUID SAMPLE

FIELD OF THE INVENTION

The present invention generally relates to a collection device for collecting a sample of liquid. More particularly, the present invention pertains to sample collection tip for collecting a blood sample that is to be analyzed for purposes of measuring the amount of a specific component in the blood sample, such as the blood sugar level in the blood sample.

BACKGROUND OF THE INVENTION

A blood sugar measuring device for measuring the blood sugar content in an individual's blood is known. This blood sugar measuring device effects the measurement of the blood sugar level by supplying blood (specimen material) to a test paper that assumes a color proportional to the amount of sugar present in the blood. The device then optically measures the degree of the coloration of the test paper, and quantifies the blood sugar content based on the results of the optical measurement.

The end of this blood sugar measuring device is adapted to receive a tip. The device performs the measurement with the tip received on the end of the device. An example of a blood sugar measuring device of this type is illustrated in FIG. 11. FIG. 11 is a longitudinal cross-section illustrating an automatic blood sugar measuring device 200 provided with a tip end 201 that receives a tip 10. The tip 10 is composed of a hollow portion 11 in the shape of a blind tube resembling a cup, a test paper 14 that is set on the inner surface of the hollow portion at the bottom part of the hollow portion 11, and a slender tube 15 extending away from the hollow portion 11. The hollow portion 11 includes a skirt part 12 provided with a flange at the end opposite the tube 15.

When the tip 10 is brought into close proximity to a specimen (blood) so that the specimen contacts the leading end of the tube 15 while the tip 10 is received on the tip part 201 of the blood measuring device 200 (with a gap 202 being provided), the specimen material flows into the tube 15 by virtue of capillary action and is transported downwardly towards the test paper 14. The specimen is supplied to the test paper 14 in the region of the central part of the test paper 14 and is then spread radially outwardly on the test paper 14. The test paper 14 carries a reagent which reacts with the blood sugar in the blood so that the test paper 14 undergoes a color change. A photometer (not shown) that includes an emitting element and a receiving element is installed in the vicinity of the tip part 201 of the blood-sugar measuring device 200. This photometer optically measures the intensity of the color change assumed by the test paper 14.

This known tip 10 illustrated in FIG. 11, by virtue of its particular configuration and construction, is susceptible of certain improvements. The tip 10 is designed as a one-time use disposable component. Thus, a new unused tip is required each time a new measurement is necessary. When the patient elects to carry one or more tips on his/her person for ready use, one or more tips 10 are stored in a case specially designed for easy transportation. In this case, because the hollow portion 11 is shaped like a cup possessing the skirt part 12, the entire height of the tip 10 is constituted by the sum of the length (i.e., height) of the skirt part 12, the thickness of the bottom wall of the hollow portion 11, and the length (i.e., height) of the tube 15. Thus, the overall height of the tip 10 is relatively large and so the specially designed case used for storing the tip(s) 10 must also be relatively large in size. This tends to make the storage and carrying of the tip(s) somewhat inconvenient. Also, the relatively large size of the tip 10 can be inconvenient when the tip 10 is to be discarded after use.

Further, as noted above, the hollow portion 11 is shaped to possess the skirt part 12. When the tip is to be manufactured by injection molding, this construction can adversely affect the tip's formability and the overall yield.

In light of the foregoing, a need exists for a specimen collection tip which can be relatively easily fabricated with relatively high yield, is well suited to being reliably attached to the end of the measuring device while also being relatively easily removed, and is capable of being conveniently stored and carried.

SUMMARY OF THE INVENTION

According to one aspect of the invention, a specimen collection tip for collecting a liquid specimen to be analyzed to determine the presence or amount of a component in the specimen includes a generally planar base portion, a longitudinally extending tube extending away from the base portion, and a test paper. The tube includes an inflow path along which the specimen is adapted to flow and the test paper is set on the base portion in communication with the inflow path for receiving specimen flowing through the inflow path. The test paper carries a reagent which reacts with the component in the specimen to produce a measurable color change indicative of the presence or amount of the component in the sample.

According to another aspect of the invention, a specimen collection tip for collecting a liquid specimen to be analyzed to determine the presence or amount of a component in the specimen includes a main body in which is formed an inflow path along which the specimen is adapted to flow and a test paper fixed in position on the base portion in communication with the inflow path for receiving specimen flowing through the inflow path. The test paper carries a reagent which reacts with the component in the specimen to produce a measurable color change indicative of the presence or amount of the component in the sample. A plurality of spaced apart mounting projections are provided on the main body for engaging a leading end part of a measuring device that is adapted to detect the measurable color change to mount the specimen collection tip on the leading end part of the measuring device.

A further aspect of the invention involves a specimen collection tip for collecting a liquid specimen to be analyzed to determine the presence or amount of a component in the specimen. The tip includes a main body in which is formed an inflow path along which the specimen is adapted to flow and a test paper fixed in position on the main body to receive the specimen flowing through the inflow path. The test paper carries a reagent which reacts with the component in the specimen to produce a measurable color change. At least one mounting projection extends from the main body for mounting the specimen collection tip at a forward end of a measuring device, with the mounting projection being spaced inwardly from an adjoining portion of the outer periphery of the main body so that the adjoining portion of the outer periphery of the main body extends outwardly beyond the at least one mounting projection for contacting the forward end of the measuring device when the specimen collection tip is mounted at the forward end of the measuring device.

BRIEF DESCRIPTION OF THE DRAWING FIGURES

Additional features and characteristics of the present invention will become more apparent from the following detailed description considered with reference to the accompanying drawing figures in which like elements are designated by like reference numerals and wherein.

DETAILED DESCRIPTION OF THE INVENTION

Figure 4:
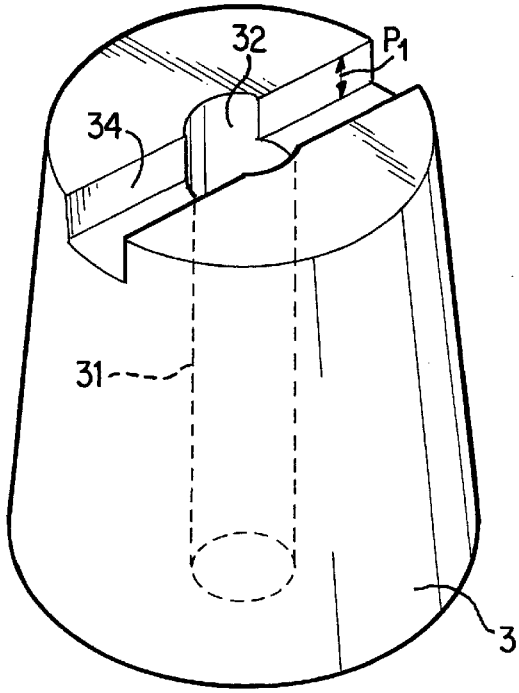
FIG. 4 is a perspective view of the collecting portion of the specimen collection tip shown in FIG. 1 illustrating the specimen inlet side part.
Figure 5:
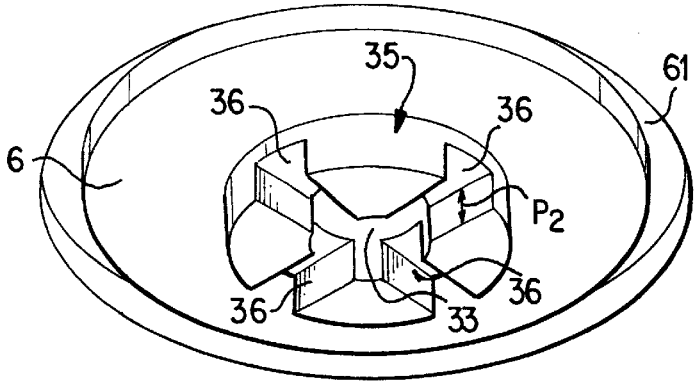
FIG. 5 is a perspective view of the specimen outlet side part of the collecting portion of the specimen collection tip shown in FIG. 1.
Figure 6:
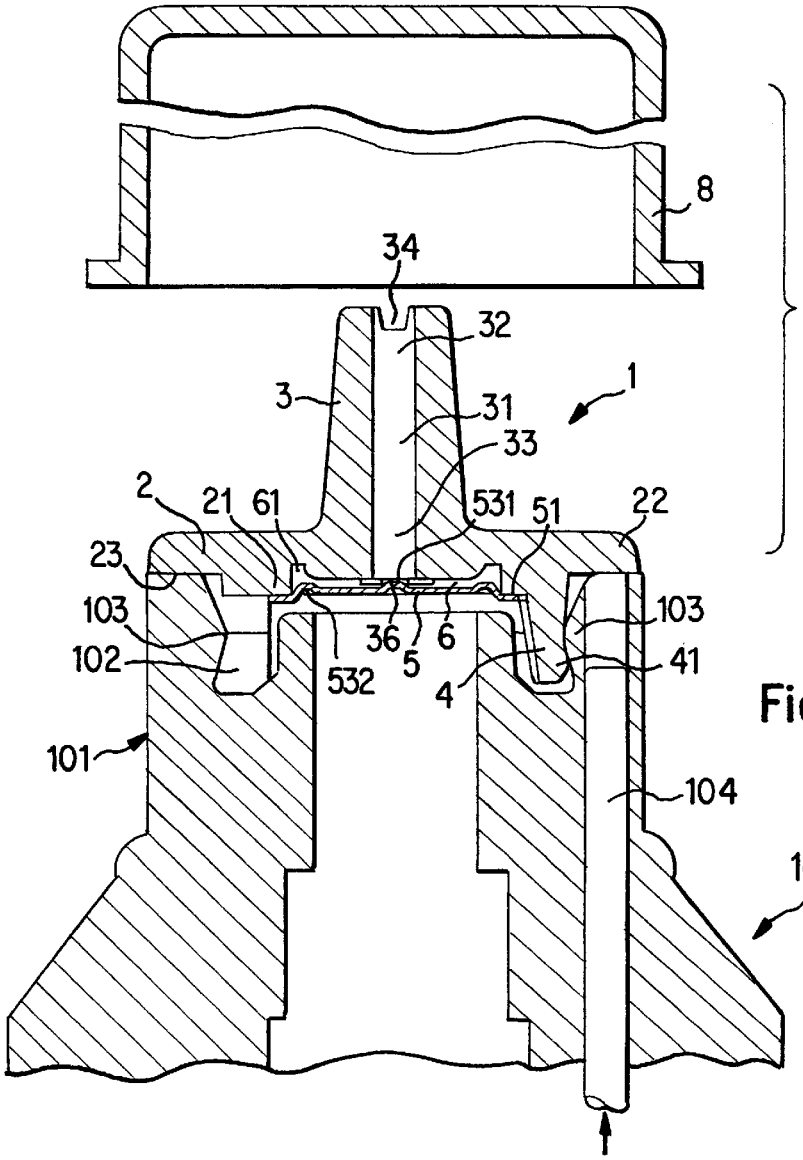
FIG. 6 is a longitudinal cross-sectional view of the specimen collection tip mounted on the tip receiving part of the measuring device.

As illustrated in FIG. 6, the specimen collection tip 1 of the present invention is adapted to be mounted on the tip receiving part 101 of a measuring device which in this described version forms an analyte measuring device 100. As shown in FIGS. 1–6, the specimen collection tip 1 is composed of a base portion 2, a slender tube 3 extending away from the upper face of the base portion, a plurality of mounting claws or mounting projections 4 extending away from the lower face of the base portion 2 in a direction opposite the slender tube 3, and a test paper 5 that is set on the lower face of the base portion 2.

The base portion 2 possesses an overall flat disc shape having a circular outer configuration, although it is to be recognized that the base portion may be other than circular in shape. For example, the base portion 2 can possess other polygonal shapes.

The thickness of the base portion 2 is not limited to any specific dimension, although it has been found that a thickness in the approximate range of 0.3 mm–3.0 mm, preferably in the approximate range of 0.7 mm–1.5 mm is quite useful. If the thickness of the base portion 2 significantly exceeds 3.0 mm, the size of the tip may be needlessly large. On the other hand, it the thickness of the base portion 2 is significantly less than 0.3 mm, the strength of the tip may be undesirably affected.

The outside diameter of the base portion 2 is preferably about equal to or smaller than the outside diameter of the leading end of the tip receiving part 101 of the measuring device. In the illustrated embodiment, the outside diameter of the base portion 2 is slightly smaller than the outside diameter of the leading end of the tip receiving part 101 of the measuring device. By virtue of this arrangement, accidental separation of the tip 1 from the tip receiving part 101 can be prevented even when the tip of an individual's finger happens to touch the outer edge part of the base portion 2 because the outer edge part of the base portion does not extend outwardly beyond the confines of the outer surface of the tip receiving part 101 of the measuring device 100 as shown in FIG. 6.

The lower face of the base portion 2 is provided with a pedestal part 21 on which is supported and fixed the test paper 5. The outer periphery of the test paper 5 forms a fixing part 51 of the test paper that is fixed or secured to the pedestal part 21. The test paper 5 can be secured or fixed to the pedestal part 21 of the base portion 2 by a variety of methods such as, for example, fusion or adhesion with an adhesive agent.

The outer periphery of the base portion 2 than is located radially outwardly of the pedestal part 21 is provided with a flange part 22. The thickness of this flange part 22 is less than the thickness of the pedestal part 21 so that the lower face 23 of the flange part 22 is recessed relative to the pedestal part 21. The lower face 23 of the flange part 22 is formed as a flat planar surface.

When the specimen collecting tip 1 is mounted on the tip receiving part 101 of the analyte measuring device 100 as shown in FIG. 6, the lower face 23 of the flange part 22 collides with or contacts the leading end face of the tip inserting part 101 and fixes the position of the tip 1 in the vertical direction with respect to the tip inserting part 101 of the analyte measuring device 100. Thus, the base portion 2 of the specimen collection tip 1 functions to position the tip 1 relative to the tip inserting part 101.

The slender tube 3 that extends away from the base portion 2 forms a capillary tube that is adapted to initially receive and draw in the specimen (e.g., blood) during use of the tip. The slender tube 3 includes a specimen inflow path 31 that extends in a direction substantially perpendicular to the test paper 5. The leading end of the specimen inflow path 31 forms a specimen inlet 32 and the opposite end of the specimen inflow path 31 forms a specimen outlet 33.

The specimen inflow path 31 is adapted to receive and draw in specimen to the test paper 5 by capillary action. It has been found that the specimen inflow path 31 is well suited to draw-in blood under capillary action when the inside diameter (average) of the specimen inflow path 31 is in the approximate range of 0.2 mm–2.0 mm, preferably in the approximate range of 0.3 mm–1.0 mm. If the inside diameter of the specimen inflow path 31 is unduly large, the transfer of the blood specimen by capillary action may be adversely affected and rendered more difficult. On the other hand, if the inside diameter of the specimen inflow path 31 is unduly small, the speed at which the blood specimen is supplied to the test paper 5 may be adversely affected (i.e., may be needlessly slowed) and the supply of the blood specimen in a sufficient amount to the test paper 5 may take an excessively long time.

The inner diameter (i.e., lateral cross-section) of the specimen inflow path 31 is illustrated as being generally constant along its entire length. However, it is to be understood that the inner diameter of the specimen inflow path 31 may vary along the longitudinal extent of the specimen inflow path 31.

The total length of the specimen inflow path 31 may be in the approximate range of 1.0 mm–10.0 mm, preferably in the approximate range of 2.0 mm–5.0 mm. If the length of the specimen inflow path 31 is excessively large, the transfer of the blood specimen by capillary action may take an unduly long time. On the other hand, if the length of the specimen inflow path 31 is unduly small, the blood specimen may possibly adhere to the outer face of the bottom part of the base portion 2 in the state shown in FIG. 10.

A groove 34 forming a first groove that communicates with the specimen inflow path 31 is formed on the leading end face of the slender tube 3. In the Illustrated embodiment, the groove 34 is a straight groove extending across the entire diameter of the slender tube 3 as shown in FIG. 4 so that the opposite ends of the groove 34 open to the outer periphery of the slender tube 3.

The provision of the groove 34 is advantageous in that it facilitates a smooth and reliable supply of the blood specimen to the test paper 5. This is because the groove 34 helps ensure that the specimen inflow path 31 remains open and is not blocked so that an inlet path for the blood specimen is secured even when the leading end face of the slender tube 3 is brought into contact with the surface of an individual's finger tip during the collection of blood. The groove 34 thus advantageously ensures that a part of the surface at the leading end face of the slender tube 3 does not directly contact the skin when the leading end face of the slender tube 3 is brought into contact with an individual's skin during use, thus providing an access path to the specimen inflow path 31 for the blood specimen.

The depth $P_1$ of the groove can be set depending upon various conditions including the condition of the skin of the individual. While this depth of the groove 34 can vary, it has been found useful that the depth $P_1$ be generally greater than 0.1 mm, preferably within the approximate range of 0.2 mm–1.8 mm. If the depth $P_1$ of the groove 34 is unduly small, the passage of the blood specimen into the groove 34 may possibly be insufficient such as when the condition of the individuals' skin results in a relatively large adhesive force of the blood to the individual's skin.

The shape, layout, etc. of the groove 34, and the number of grooves, is not limited to the embodiment shown in the drawing figures. A different shape, number and layout of grooves is possible, consistent with the objective that a part of the surface at the leading end face of the slender tube 3 does not contact the skin when the leading end face of the slender tube 3 is brought into contact with an individual's skin during use. For example, a plurality of radially oriented grooves 34 (e.g., in a cruciform pattern) positioned around the specimen inlet 32 of the specimen inflow path 31 is one possibility as is a pattern of grooves 34 laid out in a parallel manner.

A projecting part 35 is formed adjacent the end of the slender tube 3 forming the specimen outlet 33. This projecting part 35 slightly protrudes from the lower face of the base portion 2 as seen in, for example, FIG. 1. Also, as shown in FIG. 5, this projecting part 35 is provided with a plurality of grooves 36 that form second grooves. These grooves 36 communicate with the specimen inflow path 31 and are formed on the end face of the projecting part 35 that faces away from the specimen inlet 32. In the illustrated embodiment, the grooves 36 together define a cruciform shape. In addition to opening into the specimen inflow path 31, the ends of the grooves 36 open to the outer periphery of the projecting part 35.

The grooves 36 formed in the projecting part 35 are quite advantageous in facilitating the flow of the blood specimen onto the test paper 5. Blood specimen flowing through the specimen inflow path 31 and reaching the specimen outlet 33 expands outwardly from the specimen outlet 33 via the grooves 36 and is thus readily supplied to and spread out onto the test paper 5. Thus, a relatively quick and uniform spreading of the blood specimen to the test paper 5 is facilitated to thereby contribute to accurate measurement results.

The depth $P_2$ of the grooves 36 is not restricted to any particular dimension, although it has been found useful if the grooves possess a depth of at least 0.01 mm, preferably within the approximate range of 0.05 mm–0.5 mm. If the depth $P_2$ of the grooves 36 is excessively small, the grooves may not be able to adequately function in the intended manner.

Also, in a manner similar to that described above, the shape, layout, number, etc. of the grooves 36 is not limited to the embodiment shown in the drawing figures. A different shape, number and layout of grooves is possible, consistent with achievement of the intended function of the grooves. For example, a pattern of grooves 36 laid out in parallel may be employed.

Figure 1:
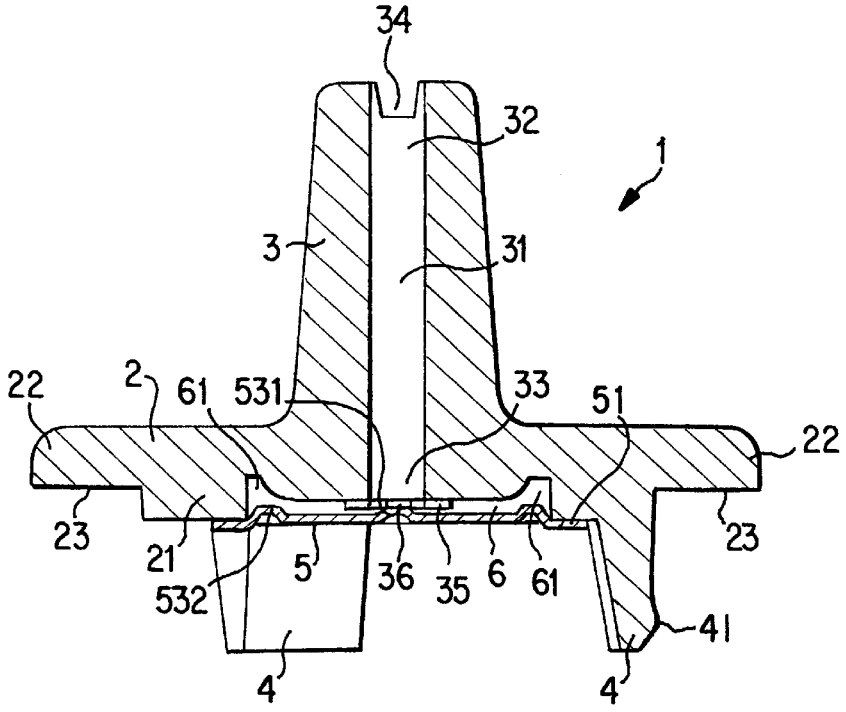
FIG. 1 is a longitudinal cross-sectional view of the specimen collection tip according to a first embodiment of the present invention.
Figure 2:
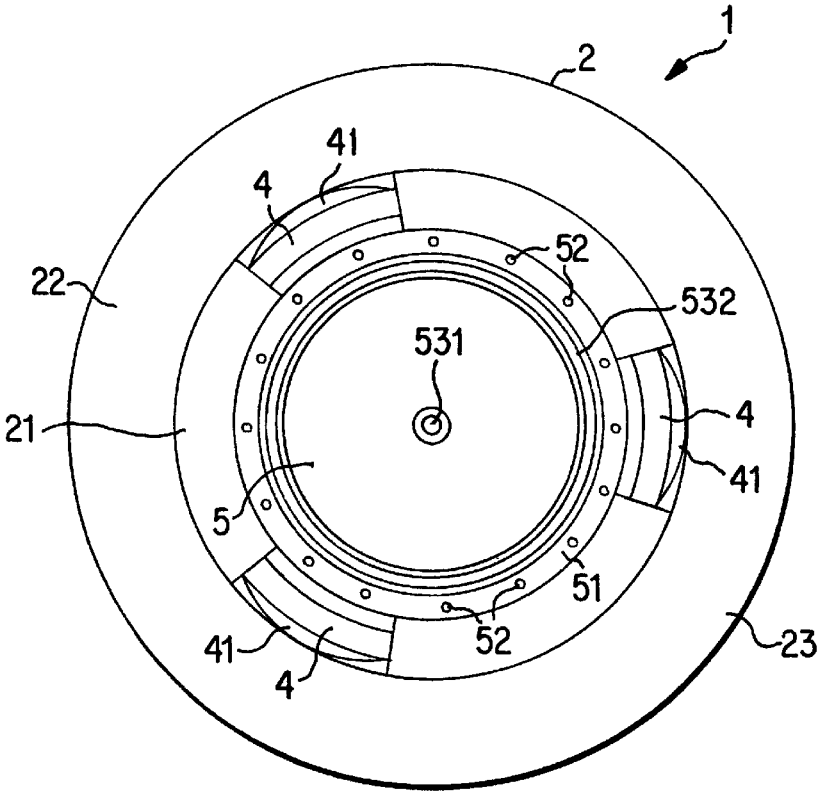
FIG. 2 is a bottom view of the specimen collection tip shown in FIG. 1.
Figure 3:
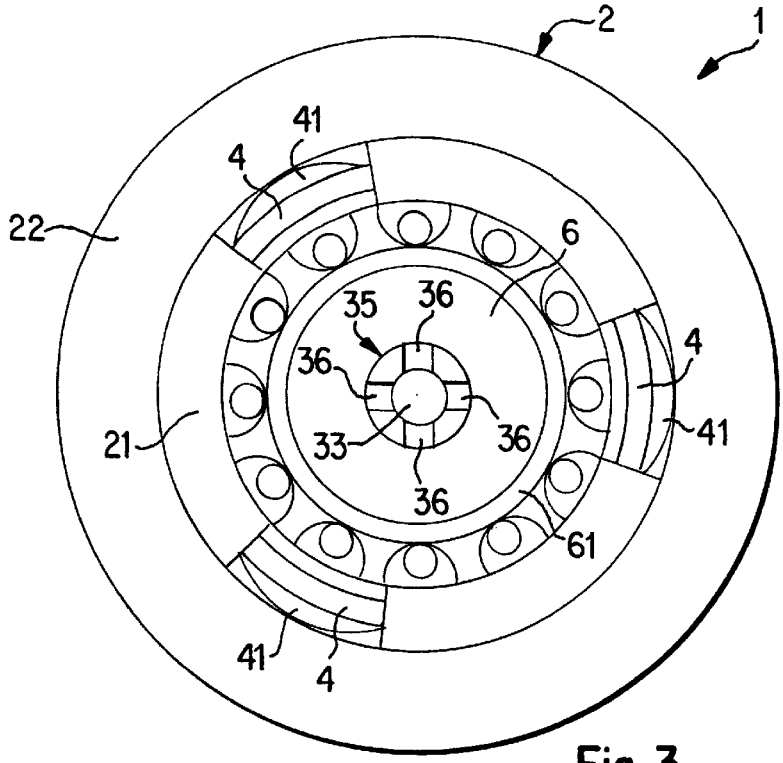
FIG. 3 is a bottom view of the specimen collection tip shown in FIG. 1 illustrating the features of the tip without the test paper.

A seen with reference to FIG. 1, the securement of the test paper 5 to the base portion 2 produces a gap 6 between the test paper 5 and the base portion 2 of the tip 1. This gap 6 is obtained by virtue of the recess that exists in the lower surface of the base portion 2 at a location inwardly of the pedestal part 21. That is, the raised pedestal part 21 to which the test paper 5 is secured results in the portion of the lower face of the base portion 2 located inwardly of the pedestal part 21 being recessed relative to the pedestal part 21. The gap 6 is thus formed and results in the portion of the tests paper 5 located inwardly of the peripheral fixing part 51 being spaced from the lower face of the base portion 2.

This gap 6 between the test paper 5 and the lower surface of the base portion 2 aids in and promotes the spread of blood on the test paper 5. The blood flowing out of the specimen outlet 33 of the specimen inflow path 31 expands radially outwardly through the gap 6 by capillary action and so the spread of the blood specimen on the test paper 5 can be effected relatively quickly and uniformly.

The depth of the gap 6 forming the spacing distance between the test paper 5 and the lower face of the base portion 2 is not limited to any particular dimension. However, the depth of the gap 6 should preferably be greater than 0.02 mm (average value), preferably within the approximate range of 0.04 mm–0.4 mm. Within these general parameters, the gap 6 is able to effectively function in the intended manner. The depth of the gap 6 may be constant along substantially the majority of the radial extent of the gap or may vary (for example, gradually decreasing) from the central part toward the outer periphery of the test paper 5.

The outer periphery of the gap 6 possesses an increased depth as seen in FIG. 1 to define a specimen reservoir 61. This reservoir 61 may possess an annular shape communicating with the gap 6 and may be produced by forming an annular recess in the lower surface of the base portion at a position just inward of the pedestal part 21. The blood which has expanded radially outwardly through the gap 6 is retained in the specimen reservoir 61 and is prevented from moving further outward toward the outer periphery of the test paper 5 that is fixed to the base portion 2 by adhesion or fusion (i.e., the fixing part 51 of the test paper 5). Also, in the event an excessive amount of the specimen is supplied through the specimen inflow path 31 to the gap 6, the leakage of excess specimen through the phenomenon of wetting can be precluded. Thus, contamination of the leading end of the tip inserting part 101 of the analyte measuring device 100 due to the adhesion of the specimen (e.g., blood) can be prevented.

The mounting claws or projections 4 are provided on the lower face of the base portion 2. In the illustrated embodiment, three mounting projections 4 are provided and are spaced apart at equal intervals from one another along the circumferential extent of the base portion (i.e., at 120 intervals). The mounting projections 4 are adapted to be elastically deformed in the radial direction of the base portion 2. As seen in FIG. 1 for example, the mounting claws 4 are positioned radially inwardly of the maximum outside diameter of the base portion 2 of the tip at a position adjacent the outer periphery of the test paper 5. More specifically, the mounting projections 4 are disposed at the outer periphery of the pedestal part 21 of the base portion 2 at the boundary with the flange part 22 of the base portion that engages the end face of the tip receiving part 101 of the measuring device.

The outwardly facing surface of each mounting claw 4 includes a radially outwardly directed protuberance 41. In the illustrated version, the protuberances 41 are each defined by tapered sides that meet at a point. As seen with reference to FIG. 6, when the tip 1 is mounted on the tip receiving part 101 of the measuring device 100, the mounting claws 4 fit into an annular recess 102 formed in the tip inserting part 101. The protuberance 41 on each mounting projections 4 engages a ridge 103 formed on the tip receiving part 101 of the measuring device 100. The ridge 103 is formed by a part of the inner wall of the recess 102 that protrudes radially inwardly toward the center. The mounting claws 4 are urged by virtue of their own elastic force to expand radially outwardly, with the protuberances 41 being pressed by this elastic force against the radially inwardly directed ridge 103. This elastic force urging the mounting claws 4 and the protuberances 41 outwardly helps maintain a reliable and effective engagement between the protuberances 104 and the ridge 103 so that the tip 1 is maintained in position on the end of the tip receiving part 101 of the measuring device 100.

Because the mounting claws 4 are positioned inside the outer periphery of the base portion 2 as described above, the mounting projections 4 remain contained within the tip receiving part 101 and are not exposed through the outer peripheral part of the tip receiving part 101. Thus, in the event the tip receiving part 101 collides with something, the tip 1 is inhibited from being removed or separated from the tip receiving part 101. Further, the mounting of the tip 1 within the recess 102 in the tip receiving part 101 of the measuring device 100 can be maintained in a rather stable manner by virtue of the disposition of the mounting claws 4 at equal angular intervals and the engagement of the protuberances 41 of the mounting claws 4 with the tip receiving part 101.

In accordance with the present invention, the slender tube 3 and the base portion 2 together define a main body that is generally a solid main body. This main body is provided with a through hole (i.e., the specimen inflow path 31) that functions as a capillary tube for drawing in a specimen and directing the specimen towards the test paper 5. The test paper 5 is set on the main body so as to communicate with the specimen inflow path 31 and receive the specimen. The main body is also provided with the mounting claws or projections 4 that allow the collection tip to be inserted into the tip receiving part 101 of the measuring device 100.

The base portion 2, the slender tube 3, and the mounting claws 4 constructed as described above are preferably formed of a resinous material. Examples of suitable resinous materials include acrylic resin, polystyrene, polyethylene, polypropylene, hard polyvinyl chloride, polycarbonate, polymethyl methacrylate, ABS resin, polyester, polyphenylene sulfide (PPS), polyamide, polyimide, polyacetal, and various resinous materials such as polymer alloys and polymer blends containing one or more of the resins mentioned above. Among resinous materials such as those mentioned above, resinous materials like acrylic resins which have a high degree of hydrophilicity or which have undergone a treatment for imparting hydrophilicity have proven to be particularly suitable for the purpose of permitting quick introduction and spread of a specimen.

The treatment for imparting hydrophilicity can be accomplished, for example, by treatments such as physical activation as plasma treatment, glow discharge, corona discharge, and ultraviolet light irradiation and by incorporation (application) of surfactant, water-soluble silicon, hydroxypropyl cellulose, polyethylene glycol, and polypropylene glycol.

The overall shape of the test paper 5 that is secured to the base portion may be circular in shape, but is not limited to such a configuration. Other possibilities include, among other shapes, elliptically shaped test paper and test paper having a polygonal shape.

When the test paper 5 is circular in shape, the outside diameter of the test paper 5 can be on the order of approximately 2 mm–12 mm, preferably in the approximate range of 3–8 mm. Of course, the size of the test paper 5 will also depend on the size of the base portion 2, including the dimension of the pedestal part 21 to which the test paper 5 is secured.

The thickness of the test paper 5 may vary, although it has been found that test paper having a thickness in the approximate range of 0.02 mm–1.0 mm, preferably in the approximate range of 0.05 mm–0.4 mm is useful.

The test paper 5 is provided with a centrally located and axially extending convex portion or protuberance 531 that extends out of the plane of the test paper 5. As seen in FIGS. 1 and 6, the protuberance 531 extends or protrudes towards the path 31. Although the height or axial extent of the protuberance 531 is not restricted to any specific dimension, the protuberance 531 is preferably dimensioned so that it extends or protrudes into the path 31, thereby being located in the specimen outlet 33. The height of the protuberance 531 can thus be on the order of about 0.02 mm–1.0 mm, preferably about 0.05 mm–0.4 mm.

The shape and outer dimension of the protuberance 531 is preferably the same as or smaller than the internal diameter of the path 31 at the specimen outlet 33. The shape, dimensions and other characteristics of the protuberance 531 are not limited by the foregoing, and are preferably appropriately selected depending upon, for example, the cross-sectional shape and dimensions of the path 31.

The protuberance 531 imparts advantageous characteristics to the test paper 5 from the standpoint of facilitating the supply of the liquid sample to the test paper 5. That is, by virtue of the protuberance 531, liquid specimen in the path 31 first contacts the test paper 5 at the protuberance 531 which preferably extends into the specimen outlet 33 which means that the liquid specimen is rapidly supplied to the test paper 5.

The test paper 5 is also provided with an axially extending annular convex portion or protuberance 532 which protrudes in the same direction as the protuberance 531. This annular protuberance 532 is positioned radially outwardly of the centrally located protuberance 531, and is disposed adjacent the outer circumference of the test paper 5. The end portion of the protuberance 532 is positioned in the specimen reservoir 61 as seen in FIGS. 1 and 6.

The annular protuberance 532 is adapted to restrict the outward spreading of the liquid specimen on the test paper 5. Consequently, excess liquid specimen is prevented from flowing out beyond the annular protuberance 532 towards the outer periphery of the test paper.

The outer diameter of the annular protuberance 532 is not restricted to any particular value, although it is preferred that the outer diameter of the annular protuberance 532 be 60%–95% of the outside diameter of the test paper 5, and preferably 70%–90% of the outside diameter of the test paper 5.

It is preferred that the width of the annular protuberance 532 be on the order of about 0.03 mm–1.0 mm, preferably in the range of about 0.05 mm 0.5 mm. The height of the annular protuberance 532 can be about 0.02 mm–1.0 mm, preferably in the range of about 0.05 mm–0.4 mm.

The shape and dimensions (e.g., diameter, width, height and the like) of the annular protuberance 532 can be appropriately selected depending on the shape and other characteristics of the main body.

The hemispherical protuberance 531 and the annular protuberance 532 can be formed by embossing(e.g., by pressign the bottom end of the test paper5 through use of a punch) or cutting out.

The test paper 5 used with the specimen collection tip and measuring device of the present invention may be produced by depositing (e.g., impregnating) a reagent (coloring reagent) on a porous sheet. Examples of materials forming the porous sheet include non-woven fabric, woven fabric, stretched sheet, membrane filter, and filter paper. Examples of the raw material used for producing the porous sheet include polyesters, polyamides, polyolefins, polysulfones, celluloses, silicates, and fluorine type resins. More specifically polyethylene terephthalate, polybutylene terephthalate, polyether sulfone, nitrocellulose, cellulose, glass, and polytetrafluoroethylene (Teflon) may be used.

Preferably, the porous sheet is impregnated with an aqueous solution of a reagent. For the sake of expediting the absorption and expansion of the specimen, the porous sheet is preferably formed of a raw material possessing hydrophilicity or subjected to a treatment for imparting hydrophilicity. The methods available for the treatment aimed at imparting hydrophilicity are the same as those cited above.

Examples of the reagents to be deposited on the test paper 5 for measuring blood sugar include glucose oxidase (GOD), peroxidase (POD), and a coloring agent (coloring reagent) such as, for example, 4-aminoantipyrine or N-ethyl-N-(2-hydroxy-3-sulfopropyl)-m-toluidine. Depending on the kind of analyte subjected to the measurement, reagents such as, for example, ascorbic acid oxidase, alcohol oxidase, and cholesterol oxidase which react with blood components and the same coloring agents (coloring reagents) as mentioned above may be used. Optionally, the reagent may additionally incorporate buffering agents such as a phosphate buffer solution. Of course, the kind and composition of the reagent is not limited to those mentioned above.

As described above, the outer peripheral part of the test paper 5 forms a fixing part 51 that is fixed to the pedestal part 21 of the tip proper 2 through, for example, fusion or adhesion with an adhesive agent. As seen with reference to FIG. 2, the test paper 5 is fixed to the pedestal part 21 at a plurality of intermittently spaced apart fixing points 52 along the outer peripheral part of the test paper 5. These fixing points 52, which are preferably disposed at equal intervals, result in spaces between the test paper 5 and the pedestal part 21, with each of the spaces being located between adjacent pairs of the fixing points 52. This construction permits ventilation to be established between the adjacent fixing points 52. As the specimen (e.g., blood) flows out of the specimen outlet 33 and is spread onto the test paper 5, the air entrapped in the gap 6 and the specimen reservoir 61 is efficiently discharged through the spaces between the fixing points 52. As a result, the spread of the specimen is expedited or facilitated.

It is also possible to fix the central part of the test paper 5 to the lower face of the projecting part 35 by way of, for example, fusion or adhesion with an adhesive agent. The test paper 5 can thus be supported on and fixed to the base portion 2 of the tip more stably. Further, obstruction of the uniform expansion of the specimen (e.g., blood) by the deformation (bending, warping, undulation, etc.) of the test paper 5 can be precluded.

In the embodiment of the present invention described above, the base portion 2, the slender tube 3, and the mounting claws 4 are formed integrally in one piece as a unitary tip. However, it is also possible to form these portions separately or of different raw materials and then join the portions together.

Figure 12:
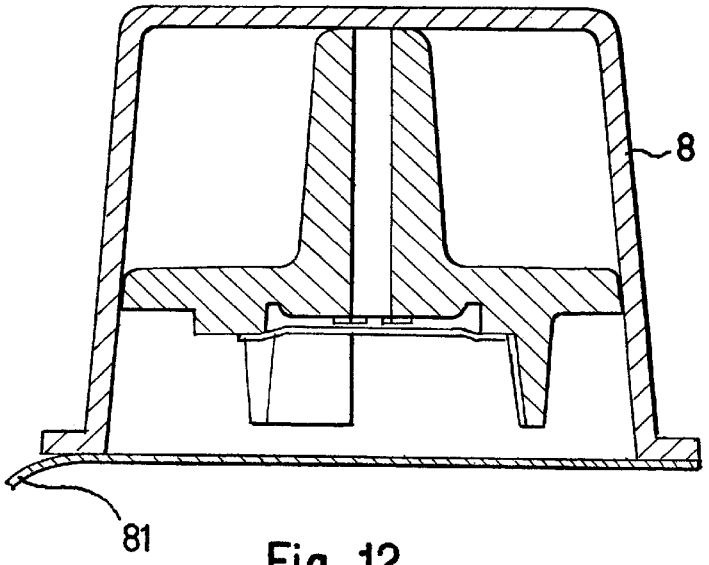
FIG. 12 is a longitudinal cross-sectional view of the specimen collection tip of the present invention accommodated in a container.

The tip 1 according to the present invention may be accommodated in a container 8 constructed in the manner illustrated in FIG. 12. The inside diameter of the container 8 and the outside diameter of the tip 1 are preferably dimensioned relative to each other so that the tip may not fall down under its weight even in the absence of a closing seal 81.

Figure 7:
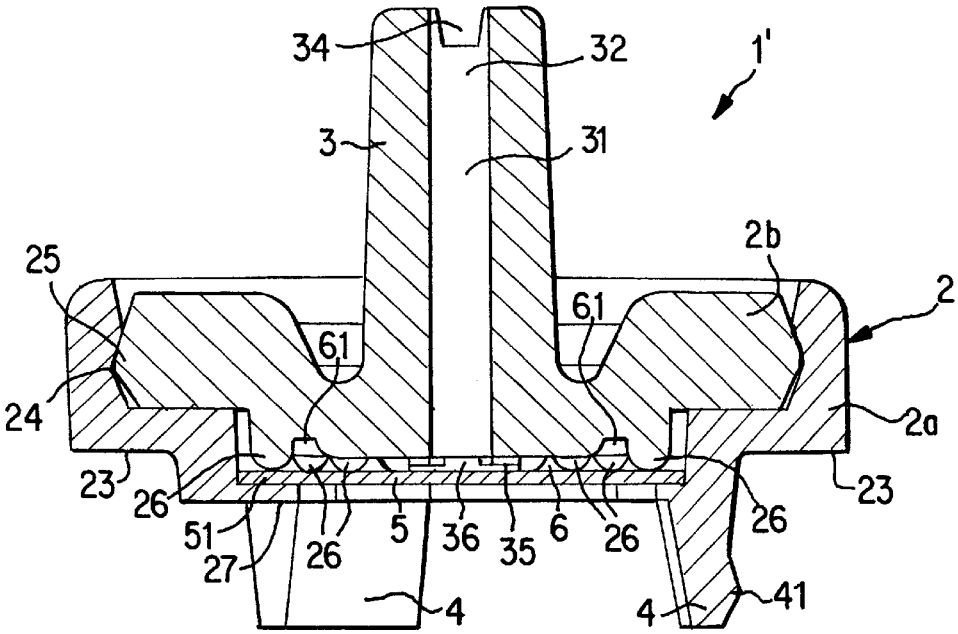
FIG. 7 is a longitudinal cross-sectional view of the specimen collection tip according to a second embodiment of the present invention.
Figure 8:
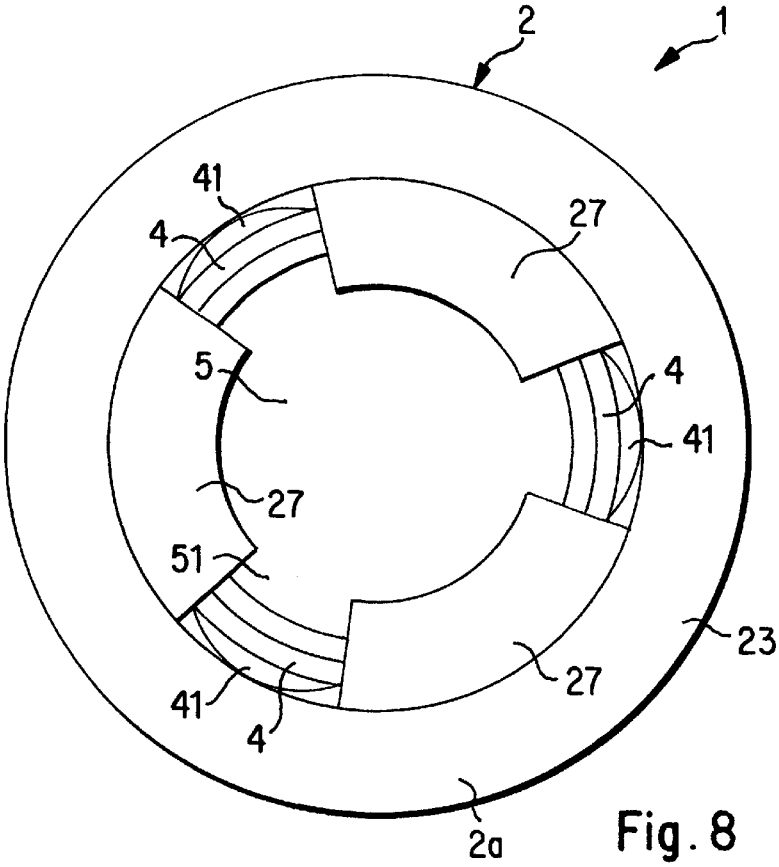
FIG. 8 is a bottom view of the specimen collection tip shown in FIG. 7.
Figure 9:
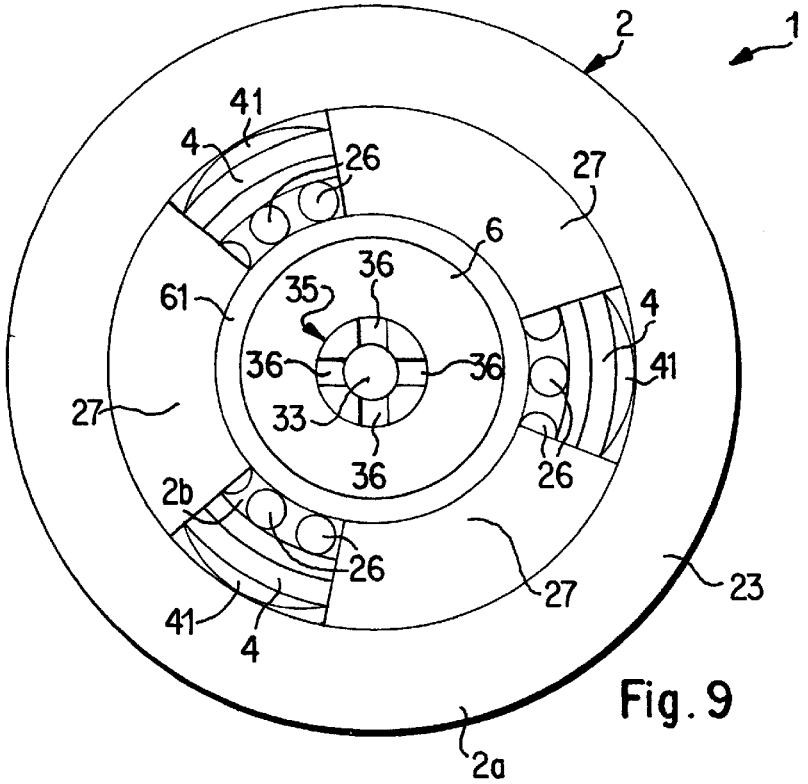
FIG. 9 is a bottom view of the specimen collection tip shown in FIG. 7 illustrating the features of the tip without the test paper.

FIGS. 7–9 illustrate a specimen collection tip according to a second embodiment of the present invention. Some of the features associated with this tip according to the second embodiment are similar to those described above in connection with the first embodiment and a description of those features will not be repeated here. The features of the second embodiment of the tip differing from those associated with the first embodiment will be described below.

The tip 1 according to the second embodiment includes a base portion 2 that is composed of two parts 2*a*, 2*b*. A first one of the parts 2*a* includes the flange part 22, the lower face 23 and the three mounting claws 4 that function in the same manner as described above. The second part 2*b* of the base portion includes the slender tube 3 that forms a capillary tube similar to that described above. The opposite ends of the slender tube 3 are similar in construction to those of the first embodiment described above in that the forwardmost end of the slender tube is provided with the groove 34 while the opposite end is provided with the projecting part 35 possessing several grooves 36.

The second part 2*b* of the base portion is fitted within the first part 2*a* of the base portion in the manner shown in FIG. 7, with the second part 26 having an upstanding outer peripheral wall that receives the first part 2*a*. An annular recess 24 is formed on the inner wall surface of the outer peripheral wall of the first part 2*a*. This annular recess 24 receives a radially outwardly facing annular protuberance 25 formed on the outer periphery of the second part 2*b*. The engagement between the protuberance 25 and the recess 24 causes the first part 2*a* and the second part 2*b* of the base portion to be coupled integrally together to form the base portion 2 of the tip 1.

The lower face of the second part 2*b* is provided with a recess defining the specimen reservoir 61. Located radially outwardly of the specimen reservoir 61 on the second part 2*b* of the base portion 2 are a plurality of spaced apart hemispherical projections 26 which form spacers for supporting the test paper 5. These projections 26 are circumferentially spaced apart on the lower face of the second part 2*b* of the base portion 2.

When the second part 2*b* of the base portion is fitted into the first part 2*a* of the base portion, the gap 61 similar to the one described above exists between the lower face of the second part 2*b* and the test paper 5. The annular recess forming the specimen reservoir 61 communicates with the gap 6 and has a depth greater than the depth of the gap 6. The functions associated with the gap 6 and the specimen reservoir 61 are the same as those described above in connection with the first embodiment.

The first part 2*a* of the base portion 2 is provided with a plurality of fan-type or arcuate shaped nipping pieces 27. The illustrated embodiment of the tip includes three nipping pieces 27, and each of the nipping pieces 27 is located between adjacent pairs of the mounting claws 4. The three nipping pieces 27 are spaced apart at an equal angular interval of 120 in the illustrated embodiment.

When the first part 2*a* and the second part 2*b* are in a coupled state as illustrated in FIG. 7, the test paper 5 is supported and fixed on the base portion by virtue of the outer peripheral part (i.e., the fixing part 51) of the test paper 5 being nipped between the projections 26 on the second part 2*b* and the nipping pieces 27 on the first part 2*a*. As shown in FIG. 7, the first part 2*a* of the base portion includes a generally centrally located opening through which the test paper 5 is exposed. As a result, when the blood specimen is absorbed on the test paper 5, the color change in the test paper can be sensed by the analyte measuring device 100.

In this version, because the projections 26 are intermittently formed in a spaced apart manner along the peripheral or circumferential direction of the second part 2*b*, the fixing points at which the test paper 5 is nipped are similarly distributed in an intermittent spaced apart manner. As a result, the spaces between the adjacent fixing points allow ventilation of air. Thus, as the specimen (e.g., blood) flows out of the specimen outlet 33 and spreads out onto the test paper 5, air in the gap 6 and the specimen reservoir 61 is efficiently discharged and so the outward spread of the specimen is not hindered but rather is facilitated.

The tip 1 according to the second embodiment of the present invention is advantageous in facilitating the fixation of the test paper 5 on the tip proper 2 because the test paper 5 is adapted to be fixed by being nipped between the first and second parts 2*a*, 2*b* forming the base portion.

The specimen collection tips 1 described above are adapted to be inserted into the tip receiving part 10 of the analyte measuring device (device for measuring a component in blood) 100. Now, the analyte measuring device 100 will be described briefly.

The analyte measuring device 100 includes the previously mentioned tip receiving part 101. The tip receiving part 101 is preferably cylindrical in shape and allows the tip 1 to be removably inserted in the leading end of the tip receiving part 101.

The tip receiving part 101 of the measuring device 100 includes the annular recess 102. This recess 102 opens into the leading end of the tip receiving part 101. The inner wall surface bounding the recess 102 possesses a radially inwardly directed annular ridge 103 having tapering surfaces as seen in FIG. 6.

The tip receiving part 101 is provided with a photometric part (not shown) that includes an emission element (light-emitting diode) and a reception element (photodiode). The emission element is adapted to generate a pulsed light at a prescribed time interval.

The analyte measuring device 100 also includes a control unit formed of a microcomputer. This control unit has a built-in operation part for computing the target component in blood (such as, for example, sugar) based on the signal from the photometric part.

In use, the specimen collection tip 1 is inserted into the tip receiving part 101, and the specimen flows to the test paper 5 in the tip 1 and is spread across the test paper 5, as will be described below, before the measurement is started. When the emission element is lit up, the light emitted from the emission element impinges on the test paper 5 in the tip 1 and produces a reflected light. The intensity of this reflected light corresponds to the intensity of the color assumed by the test paper 5. The color assumed by the test paper 5 is based on the amount (concentration) of the target component in the specimen and so the intensity of the reflected light corresponds to the amount or concentration of the target component in the specimen. The reflected light is received by the reception element and is subjected to photoelectric conversion. The reception element issues an analog signal corresponding to the amount of received light. This analog signal is converted into a digital signal and is sent to the control unit where it is subjected to required treatments such as arithmetic operations and corrections to quantify the amount of the target component in the specimen (i.e., to determine the numerical value of the blood sugar level).

Quite advantageously, the tip receiving part 101 is not contaminated by adhesion of blood because the test paper 5 does not contact the tip receiving part 101 of the measuring device while the specimen collection tip is inserted in the tip receiving part 101.

Further, while the tip is received in the tip receiving part 101 of the measuring device, the lower face 23 of the flange part 22 contacts the leading end of the tip receiving part 101 to fix the position of the slender tube 3 of the tip 1 with respect to the longitudinal direction.

The holding ability (i.e., the fitting strength) of the tip 1 relative to the tip receiving part 101 while the tip is inserted in the tip receiving part 101 is always generally constant because this holding ability is substantially exclusively dependent upon the elastic force of the mounting projections or claws 4.

The specimen collection tip 1 is accurately positioned on the tip receiving part 101 with respect to the lateral direction (i.e., in the direction defined by the plane in which the test paper lies) and is not susceptible to being shifted or moved in this direction because the mounting claws 4 are anchored with elastic pressure in the region of the radially inwardly directed ridge 103. Thus, measurement errors due to positional deviations can be diminished, thereby increasing the measurement accuracy.

From the above description, it can be seen that the specimen collection tip of the present invention is designed to efficiently collect a specimen of blood, for example, and is adapted to interface with the analyte measuring device in a way that allows the specimen collected on the collection tip to be analyzed. The specimen collection tip 1 constitutes the male portion of the interface with the measuring device 100 and is adapted to be fitted into the recess 102 (female portion) in the leading end of the tip receiving part 101 of the measuring device 100. While the leading end of the tip receiving part 101 of the measuring device 100 is covered by the base portion 2 of the collection tip 1, the upstanding outer peripheral side of the tip receiving part 101 remains exposed. Nevertheless, by virtue of the construction of the specimen collection tip 1, the exposed upstanding outer peripheral side of the tip receiving part 101 is not susceptible to being contaminated.

Figure 10:
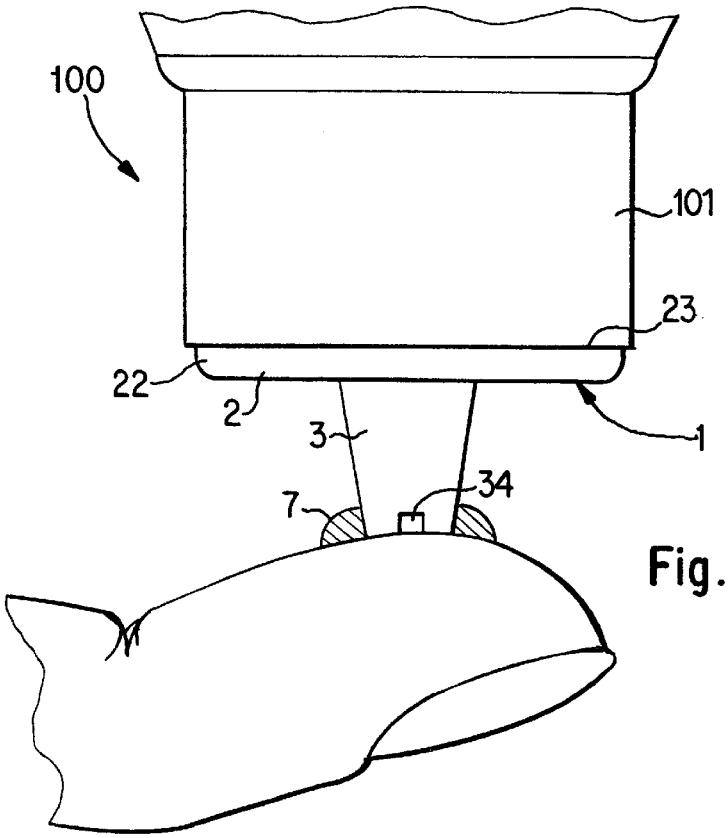
FIG. 10 is a side view of a patient's finger and the specimen collection tip of the present invention illustrating the use of the tip for collecting a specimen of blood.
Figure 11:
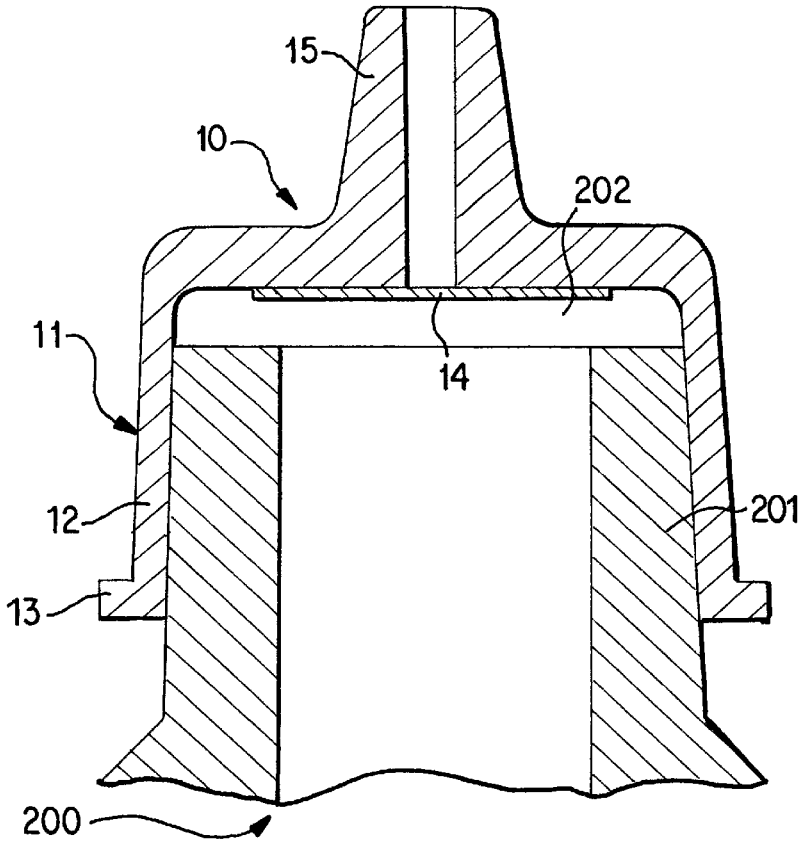
FIG. 11 is a longitudinal cross-sectional view of the end portion of a measuring device on which is mounted the collection tip of known construction.

FIG. 10 is illustrates the way in which the specimen collection tip 1 can be used to collect a specimen in the form of a blood sample. The collection of blood is initiated by piercing the individual's finger tip (or ear lobe) with a needle or a scalpel to cause blood 7 to flow out of the puncture in a small amount (e.g., in the approximate range of 2 l–6 l) onto the skin.

Meanwhile, the specimen collection tip 1 is inserted in the manner described above into the tip receiving part 101 of the analyte measuring device 100. This can be achieved by bringing the tip receiving part 101 of the measuring device 100 into engagement with the specimen collection tip 1, possibly while the tip is accommodated in the container 8 shown in FIG. 12 (after the covering seal 81 has been removed. Then, the leading end surface of the slender tube 3 is brought close to or in contact with the individual's skin. The blood 7 on the finger tip is able to flow through the groove 34 to the specimen inlet 32 and, by virtue of capillary action, flows along the specimen inflow path 32 in the direction of the test paper 5 where it reaches the specimen outlet 33. The blood 7 on the finger tip is not excessively dispersed or lost on the skin because it is efficiently drawn into the specimen inflow path 32 through the lateral surface opening of the groove 34 that opens to the outer periphery of the slender tube 3.

As the blood reaches the specimen outlet 33, part of the blood contacts the central part of the test paper 5 and is absorbed by the test paper 5. At the same, part of the blood advances through the grooves 36 in the protuberance 35 and reaches the gap 6. The blood flowing into the gap 6 is absorbed and spread by the test paper 5 that is opposed to the gap 6, and is gradually spread radially outwardly toward the outer periphery of the test paper 5. As the blood is absorbed and spread outwardly, the specimen inflow path 31 generates suction force anew and induces a continuous supply of blood to the test paper 5.

Even when the amount of the blood 7 on the finger tip is comparatively small, therefore, this blood 7 can be supplied without any waste to the test paper 5. Conversely, even when the amount of the blood 7 on the finger tip is relatively large and excessive blood is supplied to the test paper 5, the possibility of the blood leaking out of the test paper 5 and adhering to and contaminating the lower face 23 of the tip 1, the surface of the tip receiving part 101, the photometric part, or the peripheral parts of the measuring device is precluded because the excess blood is retained in the specimen reservoir 61. This excess blood is thus prevented from flowing out of the reservoir toward the outer periphery. Thus, the blood in the current specimen being measured has no adverse affect on subsequent measurement cycles with different specimens. Also, the used tip 1 can be safely discarded without causing any infection.

As the blood is supplied to and spread onto the test paper 5, the target component (such as, for example, sugar) in the blood reacts with the reagent carried on the test paper 5 and the reaction produces a color change in the test paper corresponding to the amount or concentration of the target component in the blood sample.

The amount of the target component in the blood (the numerical value of blood sugar) can be determined by optically measuring the intensity of the color change assumed by the test paper 5 through the use of the blood component measuring device 1 as described above.

By virtue of the specimen collection tip 1 of the present invention, the blood 7 can be quickly and reliably supplied to and spread across the test paper 5 in a rather simple manner. As a result, a reduction in measurement errors can be realized and the accuracy of the measurement improved.

After the measurement is completed, a pin 104 built in the tip receiving part 101 as shown in FIG. 6 is moved towards the leading end of the tip receiving part 101 of the measuring device so that the leading end of the pin 104 contacts and pushes against the flange part 22 of the tip 1 to thereby remove the used specimen collection tip 1 from the tip receiving part 101. By covering the tip 1 with the empty container 8 and then removing the tip from the tip receiving part 101, the possibility of the used tip being touched by an individual is avoided. Further, the possibility of the blood causing contamination through touch is diminished because the used tip can be discarded as accommodated in the container.

The test paper 5 used in the specimen collection tip of the present invention is not limited to a single layer construction as illustrated in the drawing figures, but may be constructed by superposing a plurality of layers on one another. The component layers of such a multi-layer construction may possess different functions. For example, in a two-layer construction, one of the two layers may function to permit the passage cf red blood cells while the other layer functions to carry the reagent.

The description set forth above is designed to facilitate an understanding of the present invention in the context of using blood as the specimen. However, the present invention is not limited to the use of blood as the specimen. The specimen materials which may be used effectively in this invention include, for example, such specimens as urine, lymph, cerebrospinal fluid, bile, and saliva, diluted liquids thereof, and concentrated liquids thereof.

Examples of target components for measurement other than blood sugar level include inorganic ions of protein, cholesterol, uric acid, creatinine, alcohol, and sodium and hemoglobin (occult blood).

The analyte measuring device fitted with the specimen collection tip of the present invention may be outfitted not only for optically measuring (color measuring) the intensity of the color assumed by the test paper as a result of the reaction of the target component in the specimen with the reagent, quantifying the result of the measurement, and displaying the numerical value, but also for electrically measuring the change in potential corresponding to the amount of the target component in the specimen material, quantifying the result of measurement, and displaying the numerical value.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A specimen collection tip adapted to be mounted on a measuring device for collecting a liquid specimen to be analyzed by the measuring device to determine the presence or amount of a component in the specimen comprising: a generally planar base portion, a longitudinally extending tube extending away from said base portion, said tube including an inflow path along which the specimen is adapted to flow, a test paper set on base portion in communication with the inflow path for receiving specimen flowing through the inflow path, said test paper carrying a reagent which reacts with the component in the specimen to produce a measurable color change indicative of the presence or amount of the component in the sample, and a plurality of spaced apart elongated mounting projections provided on the base portion for mounting the specimen collection tip on the measuring device so that the mounting projections flex outwardly upon mounting the specimen collection tip on the measuring device.

2. The specimen collection tip according to claim 1, wherein the reagent carried by the test paper is of a type which reacts with the component in the specimen to determine a concentration of the component in the specimen.

3. The specimen collection tip according to claim 1, wherein the plurality of spaced apart mounting projections extend away from the base portion in a direction opposite the direction in which the tube extends, said projections being deflectable upon mounting the specimen collection tube on the measuring device.

4. The specimen collection tip according to claim 3, wherein said base portion possesses an outer periphery, and said mounting projections being positioned radially inwardly of said outer periphery of the base portion.

5. The specimen collection tip according to claim 1, wherein said base portion is comprised of two parts, said test paper being fixed between said two parts.

6. The specimen collection tip according to claim 1, wherein said inflow path for the specimen extends in a direction substantially perpendicular to said test paper.

7. A specimen collection tip for collecting a liquid specimen to be analyzed to determine the presence of a component in the specimen comprising: a main body in which is formed an inflow path along which the specimen is adapted to flow, a test paper fixed in position on the base portion in communication with the inflow path for receiving specimen flowing through the inflow path, said test paper carrying a reagent which reacts with the component in the specimen to produce a measurable color change indicative of the presence of the component in the sample, a plurality of elongated spaced apart mounting projections provided on the main body for engaging a leading end part of a measuring device that is adapted to detect said measurable color change so that the mounting projections elastically deform in a radial direction of the base portion upon mounting the specimen collection tip on the measuring device.

8. The specimen collection tip according to claim 7, wherein the reagent carried by the test paper is of a type which reacts with the component in the specimen to determine a concentration of the component in the specimen.

9. The specimen collection tip according to claim 7, wherein said mounting projections surround the test paper.

10. The specimen collection tip according to claim 7, wherein said mounting projections each have a radially outwardly facing surface provided with a protuberance that is adapted to engage a ridge formed on an inner wall surface of a recess formed in the leading end part of the measuring device.

11. The specimen collection tip according to claim 7, wherein said main body includes a base portion possessing an outer periphery and a capillary tube extending away from the base portion in a direction opposite said mounting projections, said mounting projections being positioned radially inwardly of said outer periphery of the base portion.

12. The specimen collection tip according to claim 11, wherein said base portion is comprised of a first part and a second part, said test paper being fixed between said first and second parts.

13. The specimen collection tip according to claim 7, wherein said main body includes a flange part radially outwardly beyond the mounting projections.

14. The specimen collection tip according to claim 7, wherein said inflow path for the specimen extends in a direction substantially perpendicular to said test paper.

15. A specimen collection tip for collecting a liquid specimen to be analyzed to determine the presence of a component in the specimen comprising: a main body in which is formed an inflow path along which the specimen is adapted to flow, the main body having an outer periphery, a test paper fixed in position on the main body to receive the specimen flowing through the inflow path, said test paper carrying a reagent which reacts with the component in the specimen to produce a measurable color change, at least one mounting projection extending from the main body for mounting the specimen collection tip at a forward end of a measuring device, said at least one mounting projection being spaced inwardly from an adjoining portion of the outer periphery of the main body so that the adjoining portion of the outer periphery of the main body extends outwardly beyond the at least one mounting projection for contacting the forward end of the measuring device when the specimen collection tip is mounted at the forward end of the measuring device.

16. The specimen collection tip according to claim 15, including a plurality of mounting projections extending from the main body and spaced inwardly from the adjoining portion of the outer periphery of the main body.

17. The specimen collection tip according to claim 16, wherein said mounting projections surround the test paper.

18. The specimen collection tip according to claim 15, wherein said mounting projection has an outwardly facing peripheral surface provided with a protuberance that is adapted to engage a ridge formed on an inner wall surface of a recess formed in the leading end part of the measuring device.

19. The specimen collection tip according to claim 15, wherein said main body includes oppositely facing first and second faces, said mounting projection extending away from the first face and said test paper being fixed to said first face.

20. The specimen collection tip according to claim 15, wherein said main body includes first and second parts, said mounting projection extending from the first part and said test paper being fixed between said first part and said second part.

21. The specimen collection tip according to claim 15, wherein said inflow path for the specimen extends in a direction substantially perpendicular to said test paper.

22. The specimen collection tip according to claim 15, wherein said main body includes a base portion defined by first and second parts, said inflow path being defined by a capillary tube extending away from said second part of the base portion.

23. The specimen collection tip according to claim 22, wherein said mounting projection extends from the first part of the base portion and said test paper is fixed between said first part and said second part.

* * * * *